US009194650B2

(12) United States Patent
Hangen

(10) Patent No.: US 9,194,650 B2
(45) Date of Patent: Nov. 24, 2015

(54) FIREARM CONFIGURATION FOR REDUCING RECOIL

(71) Applicant: William A. Hangen, Winter Garden, FL (US)

(72) Inventor: William A. Hangen, Winter Garden, FL (US)

( * ) Notice: Subject to any disclaimer, the term of this patent is extended or adjusted under 35 U.S.C. 154(b) by 0 days.

(21) Appl. No.: 14/313,495

(22) Filed: Jun. 24, 2014

(65) Prior Publication Data

US 2015/0247697 A1 Sep. 3, 2015

Related U.S. Application Data

(63) Continuation-in-part of application No. 13/617,953, filed on Sep. 14, 2012, now abandoned.

(51) Int. Cl.
*F41A 21/00* (2006.01)
*F41C 23/06* (2006.01)

(52) U.S. Cl.
CPC ..... *F41C 23/06* (2013.01)

(58) Field of Classification Search
CPC ..... F41A 3/78; F41A 3/80; F41A 3/82; F41A 3/84; F41A 3/86; F41A 3/94; F41A 25/10; F41A 25/12; F41A 25/14; F41C 3/00; F41C 23/06; F41C 27/22
USPC ..... 42/1.06; 89/194, 195, 196, 199, 198
See application file for complete search history.

(56) References Cited

U.S. PATENT DOCUMENTS

| | | | | | |
|---|---|---|---|---|---|
| 2,522,192 | A | * | 9/1950 | Porter | 89/198 |
| 3,027,673 | A | | 4/1962 | Oliver | |
| 3,082,667 | A | | 3/1963 | Ramseyer | |
| 3,365,829 | A | * | 1/1968 | Shockey | 42/97 |
| 3,491,650 | A | * | 1/1970 | Rohr | 89/194 |
| 4,031,808 | A | * | 6/1977 | Raville | 89/163 |
| 4,388,855 | A | | 6/1983 | Sokolovsky | |
| 4,715,140 | A | * | 12/1987 | Rosenwald | 42/97 |
| 4,955,155 | A | * | 9/1990 | Jones | 42/69.01 |
| 5,069,110 | A | | 12/1991 | Menck | |
| 5,076,139 | A | | 12/1991 | Hiett | |
| D328,632 | S | | 8/1992 | Bigwood | |
| 5,675,106 | A | * | 10/1997 | Leiter | 89/14.5 |
| 5,734,120 | A | * | 3/1998 | Besselink | 89/163 |
| 6,212,991 | B1 | * | 4/2001 | Frazier, III | 89/196 |
| 6,530,306 | B1 | | 3/2003 | LaFleur | |
| 6,742,297 | B2 | | 6/2004 | Lakatos et al. | |
| 2009/0126559 | A1 | * | 5/2009 | Mantas | 89/44.01 |
| 2010/0031812 | A1 | | 2/2010 | Kerbrat et al. | |
| 2010/0077643 | A1 | | 4/2010 | Kerbrat et al. | |
| 2014/0075799 | A1 | | 3/2014 | Hangen | |

OTHER PUBLICATIONS

Definition of "Alignment". American Heritage® Dictionary of the English Language, Fifth Edition. Copyright © 2011 by Houghton Mifflin Harcourt Publishing Company. Published by Houghton Mifflin Harcourt Publishing Company.*

* cited by examiner

*Primary Examiner* — Gabriel Klein
(74) *Attorney, Agent, or Firm* — GrayRobinson, P.A.; Michael J. Colitz, III

(57) ABSTRACT

Disclosed is a firearm configuration for a handgun. The firearm configuration is designed to reduce the recoil forces encountered by a user upon firing the weapon. Recoil forces are reduced by lowering the firearm's center of mass and by aligning a recoiling mass with the user's arm and trigger finger. The various detail of the present disclosure, and the manner in which they interrelate, will be described in greater detail hereinafter.

2 Claims, 4 Drawing Sheets

FIREARM CONFIGURATION FOR REDUCING RECOIL

CROSS REFERENCE TO RELATED APPLICATIONS

This application claims priority to and is a continuation-in-part of co-pending application Ser. No. 13/617,953 entitled "Firearm Configuration for Reducing Recoil" which was filed on Sep. 14, 2012. The contents of this co-pending application are fully incorporated herein for all purposes.

TECHNICAL FIELD

This disclosure relates to a firearm configuration. More specifically, the present invention relates to a firing mechanism that reduces recoil, both perceived and actual.

BACKGROUND OF THE INVENTION

Handguns have grown increasingly more powerful over the years. As caliber size increases, so does the recoil of the firearm. Recoil is the rearward momentum generated by a firearm upon firing. Large caliber firearms generally create a substantial recoil impulse upon firing, which may cause the weapon to be forced upward due to an imbalance of forces. Unless properly adjusted for by the user, the recoil of a firearm may cause the user to fire inaccurately and miss the intended target. This is especially the case when firing in a fully automatic mode, as in a machine pistol.

This problem is a result of physics. The mass and velocity of a projectile must exert an equal and opposite reaction in the system behind it. This relationship is defined as "free recoil" in the firearm industry. Free recoil, in turn, results in muzzle rise. Muzzle rise is defined as the immediate, post-fire angular velocity of the firearm about its center of force. The center of force is determined by both the user's hand pressure across the grip and the handgun's own center of mass.

For the foregoing reasons, efforts have been made over the years to reduce the amount of recoil generated by a firearm. For instance, U.S. Pat. No. 6,742,297 to Lakatos discloses a firearm recoil reduction method. The method employs a spring, a trigger housing and a barrel. Additionally, U.S. Pat. No. 4,388,855 to Sokolovsky discloses a firearm pneumatic slide decelerator assembly. The assembly includes a recoil spring in proximity to a trigger housing. U.S. Pat. No. 5,069,110 to Menck discloses an impact buffering recoil mechanism. The mechanism includes a recoil spring in proximity to a trigger housing.

Although each of these inventions achieves its own individual objective, none of the background art relates to a mechanism for lessening recoil by lowering a firearm's center of mass. The firearm configuration described herein is aimed at overcoming these and other shortcomings noted in the background art.

SUMMARY OF THE INVENTION

The disclosed system has several important advantages. For example, the disclosed firearm configuration reduces the recoil encountered by the user.

A further possible advantage is that recoil forces are reduced by lowering the firearm's center of reciprocating mass. A manufacturer may further reduce recoil by overweighting the reciprocating mass in line with the hand past what is necessary for basic structural integrity.

Still yet another possible advantage of the present system is to lower the axis along which recoil forces are generated to thereby lessen the associated torque.

Another advantage of the present system is to improve the user's capacity for accuracy by reducing recoil. Higher recoil forces disrupt most firearm users' concentration and inflame something akin to the "fight or flight" instinct, so less recoil equals less psychological disruption, which in turn promotes the users' capacity for accurate fire. This increase in accuracy via reduced recoil is most pronounced in the application of this system to a machine pistol format, as such weapons are generally less controllable due to their light weight, comparatively meager grip surface area, and high rate of fire in full automatic mode.

Another advantage is realized by utilizing a firearm configuration that allows the manufacturer to integrate the recoil spring guide rod with the frame, resulting in fewer parts and lowering manufacturing costs. This also has the beneficial result of simplified disassembly procedures for the end user and increased reliability of the weapon.

A further advantage is that the firearm configuration of the present disclosure decreases overall weapon height with no appreciable reduction in magazine capacity as compared to known designs. Alternatively, the present configuration can result in a weapon of equal height to known designs, but with an increased magazine capacity.

A further advantage of the present system is that it allows a user to execute quicker follow-up shots, as the recoil forces impeding faster shots will be reduced.

The firearm configuration of the present disclosure also reduces the recoil of a given cartridge, which allows more powerful ammunition to be utilized with approximately the same recoil as a conventional configuration. The use of more powerful ammunition, in turn, allows for a flatter bullet trajectory and thus increased effective range of a handgun. Also, the ability to use more powerful ammunition with the same recoil allows for the use of larger-caliber armor-penetrating bullets, resulting in increased lethality and effectiveness on the battlefield.

Another advantage is that the system provides for a lower barrel axis when combined with a rotating barrel locking mechanism, further reducing recoil.

The advantages of the present system may be further maximized by using any or all of the following additional design elements: use of a sliding trigger assembly, use of a striker firing mechanism, or use of external or "slide in frame" guide rails.

A further advantage of the present system is that it may be configured to eliminate the snag or catch point located at the front corner of the trigger guard, thereby making the action of holstering or unholstering the weapon easier.

Various embodiments of the invention may have none, some, or all of these advantages. Other technical advantages of the present invention will be readily apparent to one skilled in the art.

BRIEF DESCRIPTION OF THE DRAWINGS

For a more complete understanding of the present disclosure and its advantages, reference is now made to the following descriptions, taken in conjunction with the accompanying drawings, in which.

DETAILED DESCRIPTION OF THE DRAWINGS

The present disclosure relates to a firearm configuration for a handgun. The firearm configuration is designed to reduce the recoil forces encountered by a user upon firing the weapon. Recoil forces are reduced by lowering the firearm's center of mass and by aligning a recoil mass with the user's arm and trigger finger. The various details of the present disclosure, and the manner in which they interrelate, will be described in greater detail hereinafter.

Figure 1:
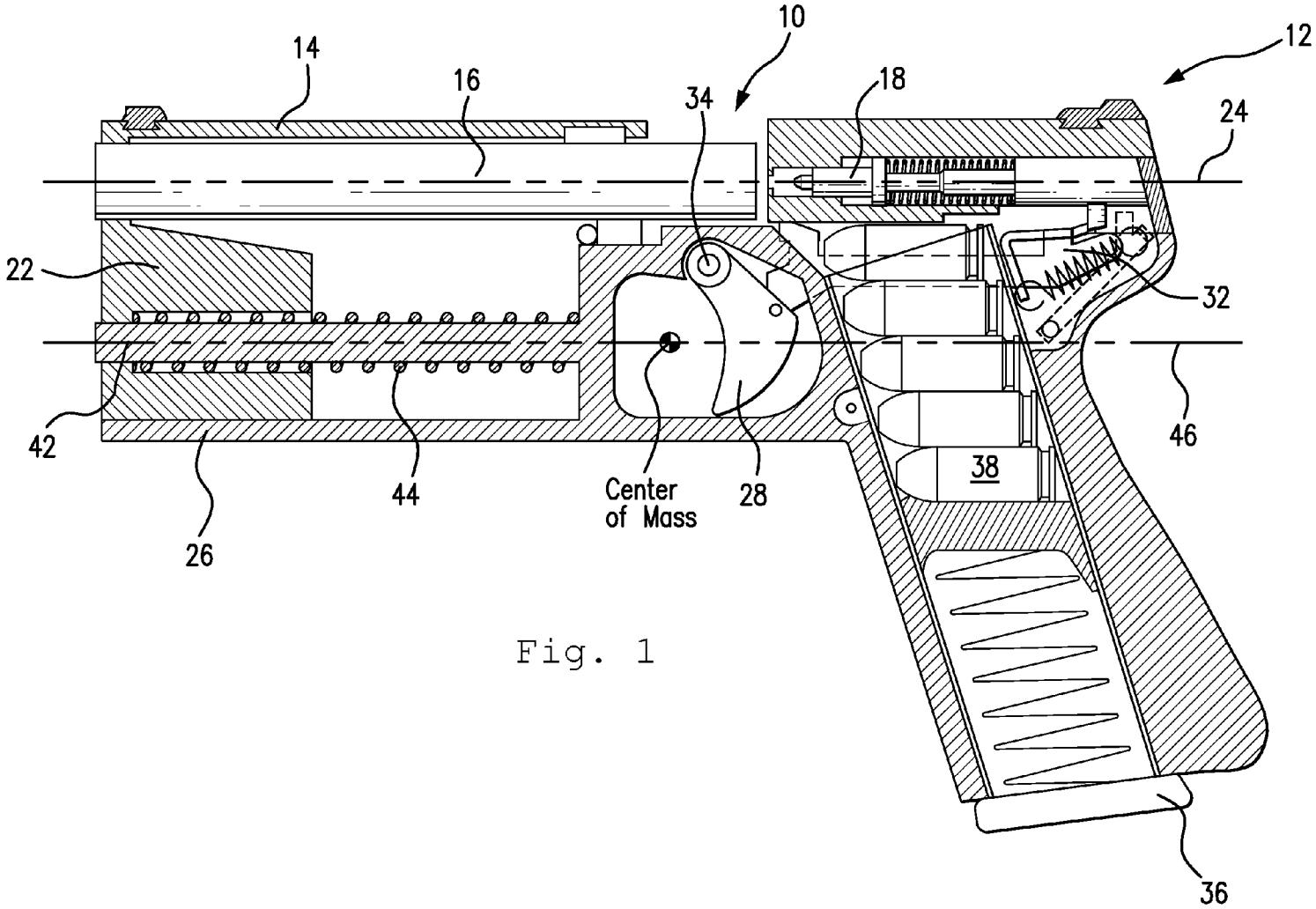
FIG. 1 is a cross sectional view of the firearm configuration prior to firing.
Figure 2:
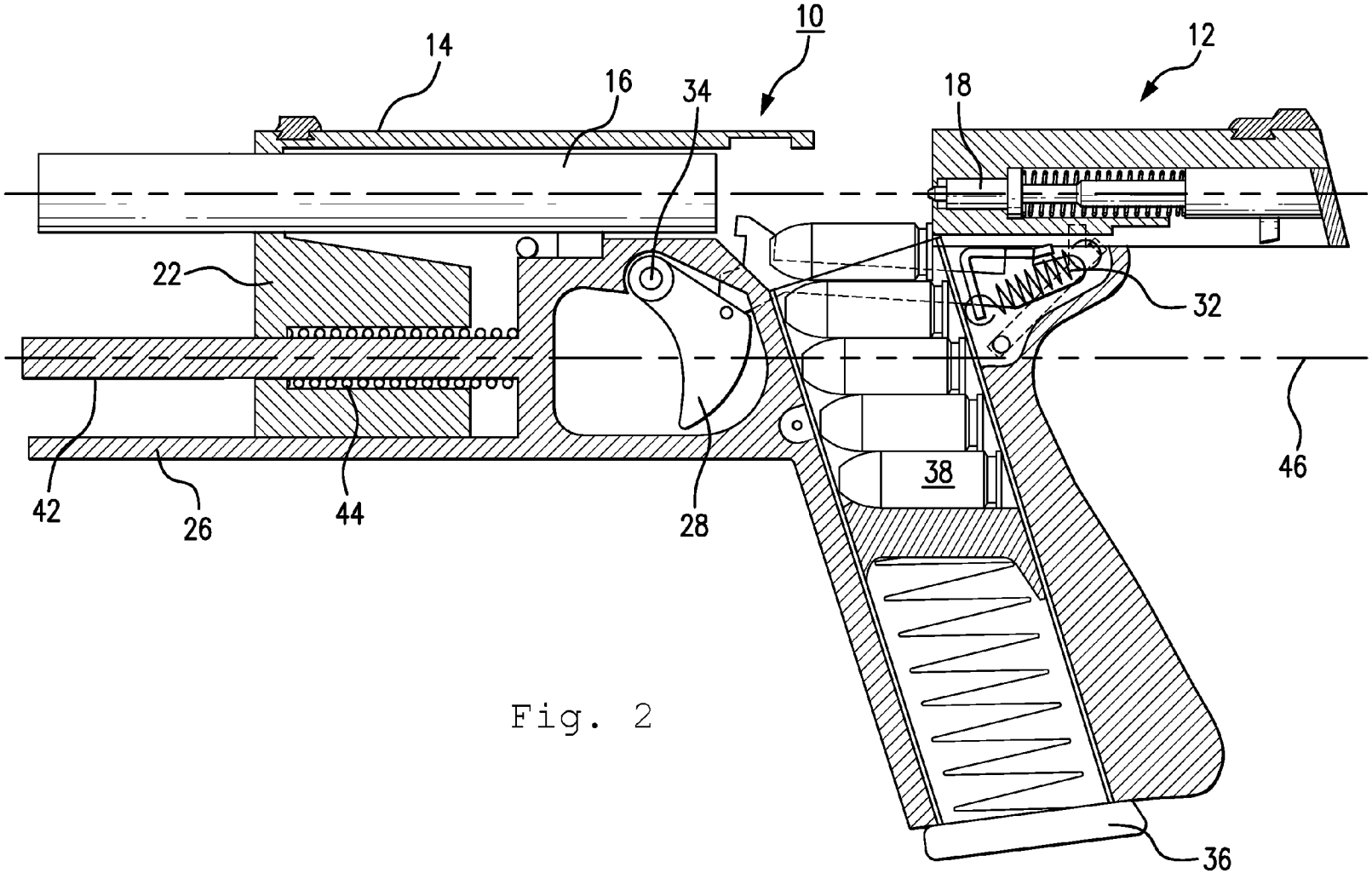
FIG. 2 is a cross sectional view of the firearm configuration after firing.

With reference now to FIGS. 1 and 2, the firearm configuration (10) of the present disclosure is disclosed. As noted, configuration (10) assists in reducing recoil forces encountered by the user of an associated firearm (12). The configuration (10) includes an upper housing (14). Upper housing (14) houses a barrel (16) and a firing assembly (18). The barrel (16) and firing assembly (18) are of a conventional construction. The specific trigger (28) and trigger assembly (32) depicted are of the type found in the Glock® series of handguns. Upper housing (14) further includes a recoil mass (22) with an opening. In one possible embodiment, recoil mass (22) is tapered along its upper edge, with a thicker forward end and a narrowed rearward end. The recoil mass (22), however, need not be tapered. As noted in the figures, barrel (16) and firing assembly (18) are positioned in axial alignment with one another and are positioned along a first axis (24). First axis (24) is defined prior to the weapon being fired. The firing assembly (18) can take the form of a conventional striker firing assembly or a conventional hammer firing assembly. The use of other conventional firing assemblies is also within the scope of the present disclosure. One suitable firing assembly is disclosed in U.S. Pat. No. 8,156,677 entitled "Assemblies and Firearms Incorporating such Assemblies," which issued to Gaston Glock on Apr. 17, 2012. The contents of this issued patent are fully incorporated herein for all purposes.

Configuration (10) further includes a lower housing (26) that is slidably interconnected to the upper housing (14). A trigger (28) and trigger assembly (32) are positioned within the lower housing (26). The disclosed trigger (28) is a pivoting trigger, but sliding triggers can also be used in connection with the present invention. The depicted trigger (28) and trigger assembly (32) are of the type found in the Glock® series of handguns, as well as U.S. Pat. No. 8,156,677, and are of a standard and well known construction. In accordance with the invention, trigger (28) pivots about a second axis (34). Second axis (34) is positioned below, and is perpendicular to, the first axis (24). The trigger assembly (32) is interconnected to the striker assembly (18). As is known in the art, ammunition (38) is delivered upwardly from the magazine (36) under a spring force into the upper housing (14). Individual cartridges to be fired are delivered between the barrel (16) and the firing assembly (18). Trigger assembly (32) is used to selectively actuate the striker assembly (18) and fire the firearm (12). The relationship between trigger assembly (32) and striker assembly (18) will be appreciated to those of ordinary skill in the art. The exact mechanism employed does not form part of the present invention and can be similar to that utilized by the type found in the Glock® series of handguns.

Lower housing (26) further includes a guide rod (42) and recoil spring (44) that extend through the opening in the recoil mass (22). Recoil spring (44) has an end seated within recoil mass (22). Guide rod (42) is positioned along a third axis (46). The third axis (46) is positioned below the second axis (34). Guide rod (42) is integral with the lower housing (26).

In accordance with the present disclosure, when a user fires firearm (12), the upper housing (14) slides back with respect to the lower housing (26). This action, in turn, causes the recoil mass (22) to slide along the guide rod (42) to compress the recoil spring (44). The recoil generated by firearm (12) is greatly reduced by the position and movement of the recoil mass (22). More specifically, the axis of the recoil spring (44)—i.e. the third axis (46)—is parallel to and below the first axis (24), which is an axis drawn down the centerline of the barrel (16) prior to the firing of the weapon, and upon which the bullet exits the barrel. In this regard, the first and third axes (24) and (46) remain parallel to each other at all times during firing. As a result, the linear momentum generated by ammunition (38) leaving barrel (16) is completely countered by the linear momentum of the recoil mass (22) moving towards trigger (28). In other words, ammunition (38) leaving barrel (16) travels on a vector that is 180 degrees from the vector of the recoil mass (22). The positioning of recoil mass (22) below barrel (16) and striker assembly (18) also effectively lowers the center of mass of the overall firearm (12). In the preferred embodiment, the center of mass is in alignment with the recoil spring (44) (see FIG. 1). It should be noted that the exact center of mass may change as ammunition (38) is depleted. Nonetheless, it is preferred to keep the center of mass as closely aligned with recoil spring (44) as possible. By lowering the center of mass, there is no lever arm created between the trigger finger or arm and the center of mass. Such a lever arm would multiply any recoil forces and produce unwanted torque.

Recoil is further reduced by positioning the axis of trigger (28)—i.e. the second axis (34)—in close proximity (i.e. approximately 1 inch or less) to the first axis (24). This ensures that the recoil mass (22) is in alignment with the user's trigger finger and/or arm upon firing. Computer modeling of the claimed invention demonstrates that a recoil mass of approximately 0.38 lbs., located approximately 3.1 inches forward of, and approximately 0.5 inches beneath, the center of force greatly reduced the associated muzzle rise. Specifically, the modeling showed that about 22% more free recoil was absorbed as compared to a conventional firearm. Likewise, muzzle rise was reduced by approximately 59%.

Figure 3:
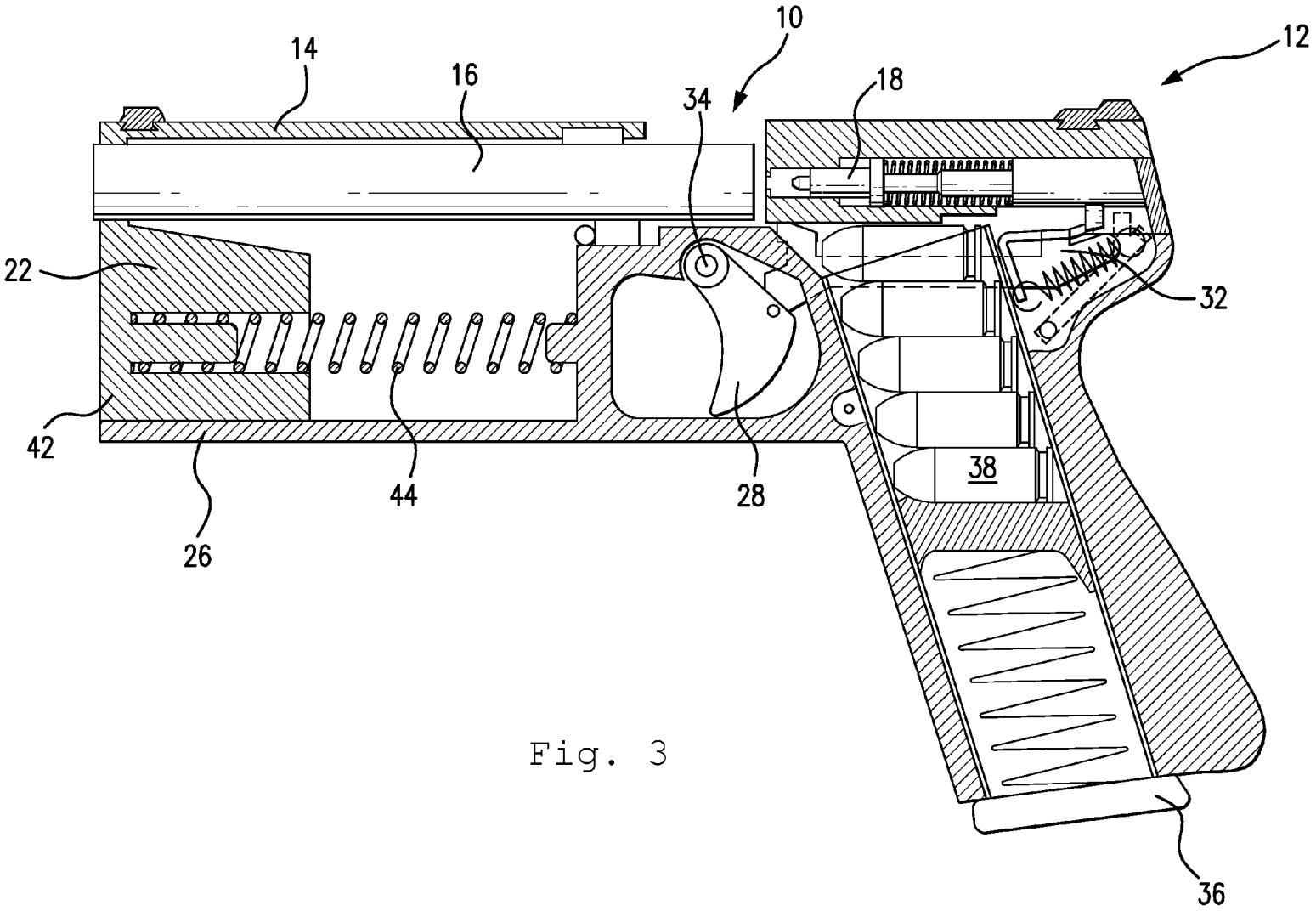
FIG. 3 is a cross sectional view of an alternative embodiment of the firearm configuration prior to firing.
Figure 4:
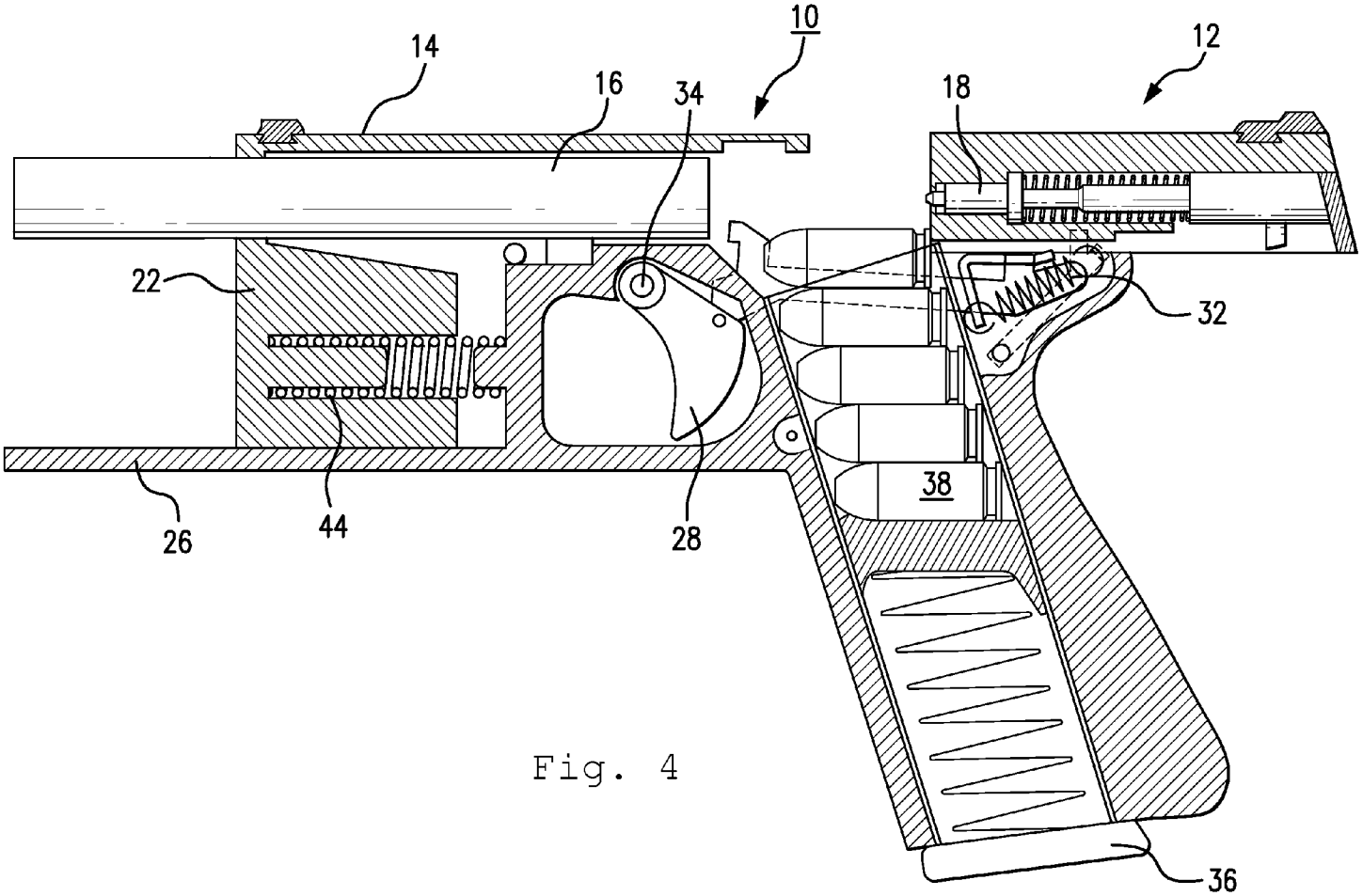
FIG. 4 is a cross sectional view of an alternative embodiment of the firearm configuration after firing.

A second embodiment of the firearm (12) is illustrated in FIGS. 3 and 4. This embodiment is the same in most respects as the firearm (12) depicted in FIGS. 1 and 2. However, in the second embodiment, the guide rod (42) does not extend through the recoil mass (22). Instead, the guide rod (42) is replaced by a first guide rod portion (42*a*) that extends from within the recoil mass (22). Additionally, a second guide rod portion (42*b*) extends from the area in front of the trigger. Guide rods portions (42*a* and 42*b*) are preferably in alignment. Recoil mass (22) is adapted for liner movement within second housing (26) and in alignment with trigger (28). Thus, in the second embodiment, the guide rod (42) does not fully extend within recoil spring (44). Instead, first guide rod portion (42*a*) extends a short distance within the first end of spring (44) and the second guide rod portion (42*b*) extends a short distance within the second end of spring (44). This embodiment is possible because it has been discovered that spring (44) does not need to be supported along its entire length to be effective. This reduces the overall weight of firearm (12) without any reduction in the effectiveness of the recoil mass (22). It should be noted that second guide rod portion (42*b*) merely fixes the position of the recoil spring adjacent trigger. Accordingly, other configurations, such as an appropriately sized cavity can be used to fix the position of spring (44). Still yet other retaining mechanisms, in lieu of guide rod portions (42*a* and 42*b*) can be used. It is also possible to eliminate the use of any retaining mechanisms.

At its most basic, this reconfiguration takes the guide rod (42) from being a passive part in the recoil cycle to an active part of the recoil cycle, making the resultant weapon more efficient with regard to the use of existing weight.

The reconfigured guide rod (42*a* and 42*b*) also increases the mass of the recoil mass (22), which can be relocated lower in front of the trigger. This allows for a greater reduction in recoil and/or muzzle rise. The weapon has further reduced recoil over our previous work, and further lowers the firearm's center of reciprocating mass. As such, it is an example of overweighting the reciprocating mass in line with the hand past what is necessary for basic structural integrity. Also, though the axis on which the spring is guided is not further lowered, the overall axis along which recoil forces are transmitted to the user is further lowered with this addition.

The use of the reconfigured rod (42*a* and 42*b*) also reduces the total part count by integrating the guide rod with the slide (as opposed to the frame), thus allowing for decreased production cost and increased reliability. The reconfigured guide rod (42*a* and 42*b*) still allows for similar disassembly in comparison with current designs, and thus does not require additional training. The reconfigured guide rod (42*a* and 42*b*) further reduces recoil, which allows for more rapid follow-up shots and for the use of more powerful ammunition.

Increasing the mass present in the slide internally allows for a weapon with the same exterior slide dimensions to fire more powerful ammunition; alternatively, it allows for a reduction in the exterior slide dimensions of the weapon while still allowing for an identical level of ammunition power.

In the case of an existing pistol using a steel guide rod, this relocation would shift a portion of the total weapon weight from the frame assembly to the slide, essentially allowing for a pistol of equal weight to fire more powerful ammunition in comparison to said existing pistol. This comparison is between a modified and an unmodified pistol both using a half-length guide rod—as such, you could take a pistol with an existing full-length guide rod and modify it by relocating the guide rod (substituting a half-length one) to the slide, thereby creating a pistol both lighter than the unmodified version and yet still able to use more powerful ammunition. Such a substitution is once again assuming all guide rods in both pistols are composed of steel.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A firearm configuration (10) for reducing recoil forces encountered by the user of a firearm (12), the firearm configuration (10) being triggered by the user's trigger finger, the firearm configuration comprising:

a first housing (14), the first housing including a barrel (16) and a firing assembly (18), the first housing (14) having a recoil mass (22) with an opening;

a second housing (26) slidably interconnected to the first housing (14), a trigger (28) and trigger assembly (32) positioned within the second housing (26), the trigger assembly (32) being interconnected to the firing assembly (18), the trigger assembly (32) being used to selectively actuate the firing assembly (18) and fire the firearm (12), the second housing (26) further including a recoil spring (44) extending into the opening in the recoil mass (22), the recoil mass (22) adapted for linear movement within the second housing (26) and linearly along a line that the trigger (28) is disposed along;

a first guide rod portion (42*a*) extending from the recoil mass (22) and partially into the recoil spring (44), a second guide rod portion (42*b*) extending from a location opposite the recoil mass (22) and partially into the recoil spring (44);

wherein after firing the firearm (12), the first housing (14) slides back with respect to the second housing (26) and the recoil mass (22) slides within the second housing (26) thereby compressing the recoil spring (44), and wherein the recoil of the firearm (12) is reduced by positioning the recoil mass (22) in line with the user's trigger finger or arm;

wherein a first axis (24) extends along the barrel (16), the trigger (28) pivots about a second axis (34), a third axis (46) extends along the first and second guide rod portions (42*a* and 42*b*) and wherein the third axis (46) is located below the first axis (24) and the second axis (34).

2. The firearm configuration (10) as described in claim 1 further comprising a magazine (36) with ammunition (38), the ammunition (38) being delivered upwardly into the upper housing (14) between the barrel (16) and the firing assembly (18).

* * * * *